US005218787A

United States Patent [19]

Rice

[11] Patent Number: 5,218,787

[45] Date of Patent: Jun. 15, 1993

[54] APPARATUS FOR SHARPENING IMPLEMENTS

[76] Inventor: Gary F. Rice, 127 North St., Gahanna, Ohio 43230

[21] Appl. No.: 766,579

[22] Filed: Sep. 27, 1991

[51] Int. Cl.[5] ..... B24B 3/00

[52] U.S. Cl. ..... 51/91 BS; 51/92 BS; 51/217 R; 51/230

[58] Field of Search ..... 51/72 R, 74 R, 74 BS, 51/91 BS, 91 HK, 92 BS, 92 HK, 216 R, 216 A, 217 R, 217 A, 218 R, 218 A, 221 BS, 222, 224, 230, 285, 371

[56] References Cited

U.S. PATENT DOCUMENTS

| | | | |
|---|---|---|---|
| 279,790 | 1/1883 | Hamilton . | |
| 434,124 | 8/1890 | Williams | 51/91 HK |
| 629,069 | 7/1899 | Fowler . | |
| 1,119,723 | 12/1914 | Porter . | |
| 3,355,841 | 12/1967 | Niquet | 51/94 R |
| 3,427,753 | 2/1969 | Hoch et al. | 51/94 R |
| 3,656,263 | 4/1972 | Jocobsen | 51/238 |
| 3,733,751 | 5/1973 | Williams | 51/92 BS |
| 3,885,352 | 5/1975 | Juranitch | 51/218 R |
| 4,936,053 | 6/1990 | Shanelec | 51/92 |
| 4,961,288 | 10/1990 | Ketteringham | 51/92 BS |
| 4,984,391 | 1/1991 | Sattler | 51/92 BS |

OTHER PUBLICATIONS

S.I.P. Grinding Machine Co., Peerless advertisement Rotary Blade Grinder.

Foley United Advertisement Model 398 Rotary Blade Grinder.

Bexley Equipment Company, Rotary Blade Grinder Magna-Matic Corp. Blade Cutting Edge Grinding-MAG-9000.

*Primary Examiner*—M. Rachuba

*Attorney, Agent, or Firm*—Mueller and Smith

[57] ABSTRACT

A fixture form of apparatus is provided which performs in conjunction with a typical bench grinder to retain and maneuver implements having to be sharpend such as mower blades. The apparatus includes a base member upon which is mounted a forwardly disposed hinge assembly. From this hinge assembly extend paired parallel cylindrical guide rods which form the raceway of lateral bearings, in turn, supporting and forming part of a carriage assembly. On the carriage assembly, there is mounted a clamping mechanism formed of a portion of conventional over-center gripping pliers which are pivotable about a grip axis and, further, a bracket supports the gripping components to achieve pivotal adjustment about a bracket axis. Implements are mounted in the apparatus after it is pivotally maneuvered rearwardly to a mount position spaced away from the grinding environment. The assemblage may be provided with a cutting depth bracket to simplify the sharpening process as well as a base position adjustment assembly serving to provide more accurate base positioning upon a work surface before the bench grinder assembly.

21 Claims, 2 Drawing Sheets

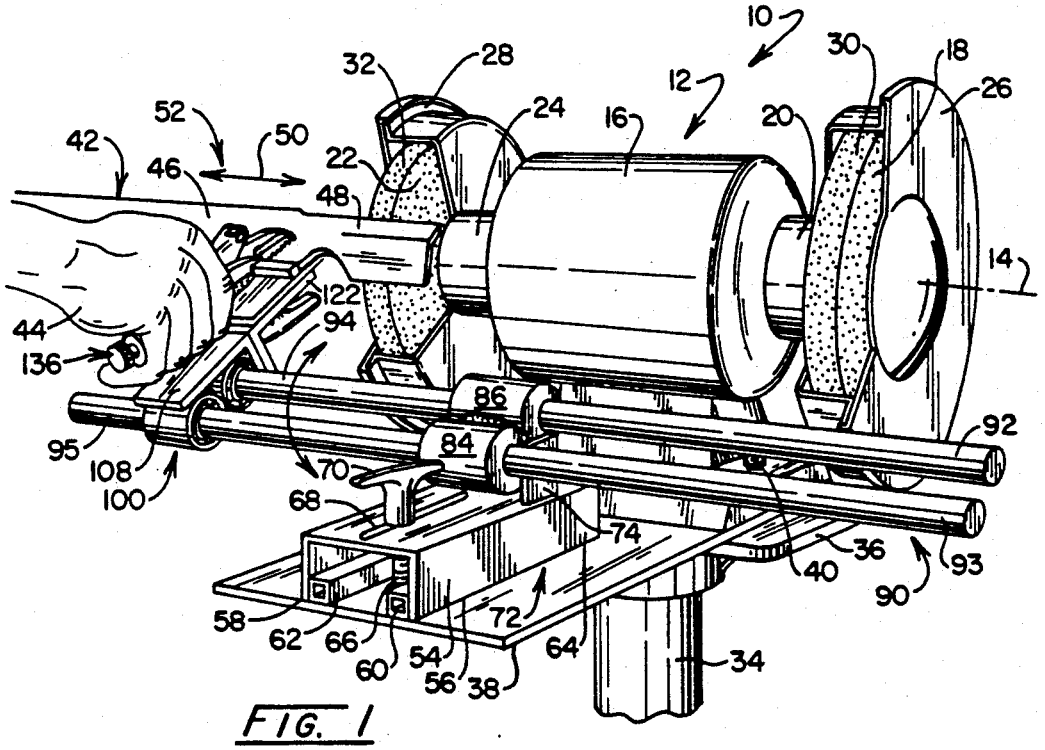
FIG. 1
FIG. 2
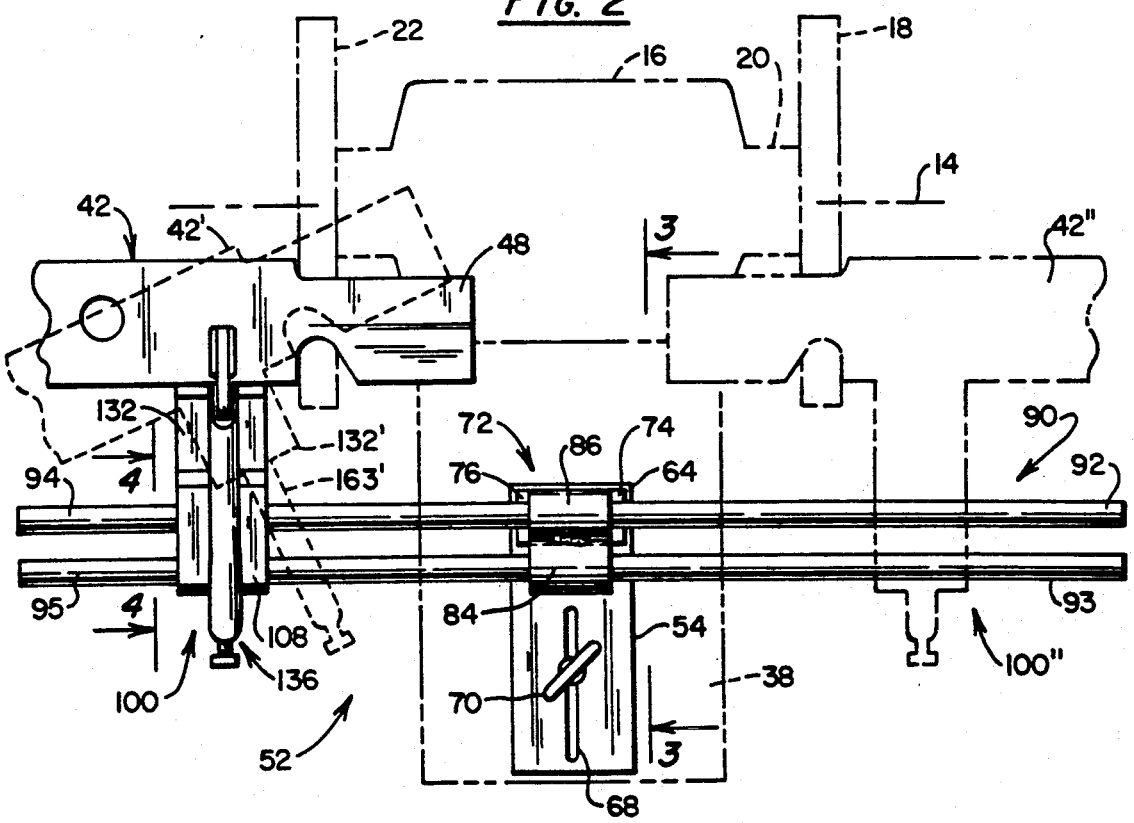

APPARATUS FOR SHARPENING IMPLEMENTS

BACKGROUND OF THE INVENTION

The techniques used by maintenance facilities and shop practitioners for sharpening such implements as mower blades, chipper blades, field assemblies and the like heretofore have been somewhat conventional. Shops carrying out these sharpening procedures typically will have one or more of the ubiquitous dual stone or grinding wheel bench grinders. These grinders are fashioned as an electric motor, the elongate shaft of which supports oppositely disposed grinding wheels. Personnel selected to carry out sharpening duties usually are seen to be hand supporting the implement being sharpened upon a small bracket positioned at about the center height before the stone. Given an experienced operator, this sharpening procedure is effective, but dangerous and accident prone. Of particular note, the procedure is slow and quite fatiguing to the operator. For the most part, only shop personnel of somewhat extensive experience are called upon to perform sharpening tasks. For newcomers to the art, a considerable training interval generally is called for.

Some grinding jig assemblies have been introduced to the industry, but have shown little improvement over the above, basic technique. For example, some blade sharpening assemblies position a grinding wheel partially within a slot formed in a support surface. The blade is then drawn by hand along a stationary blade guide and grinding occurs at a location below the rotational axis of the grinding wheel. That location tends to undesirable binding conditions or phenomena. Additionally, such techniques, as well as other elaborate approaches, will not accommodate to more recent mower blade designs having aerodynamically based contours.

SUMMARY

The present invention is addressed to apparatus for carrying out the sharpening of implements such as mower blades, chipper blades, tools, and the like which achieves very high quality sharpening results with substantially reduced effort and time expenditure. The apparatus is readily usable by entry level shop personnel and permits high quality sharpening of implements with substantially reduced shop accident risks. Implements to be sharpened are mounted upon the apparatus at mount positions safely remote from the grinding wheel components and the hand control procedures during grinding are designed to position the operator hand at a safe location remote from the grinding environment. This implement mounting procedure also is quite simple, only one gripping component being used and that component preferably being over-center locking pliers, the hand grip of which serves as the hand control component of the sharpening system. Accuracy and stability is achieved through the use of a carriage and guide rod assemblage performing in conjunction with a centrally disposed hinge structure. The safety of the system is enhanced by a design which positions the workpiece edge to be sharpened at a location on the grinding surface above the shaft or center, thus tending to avoid binding phenomena and the like. Because the adjustability of the apparatus is combined with a highly desirable stability of implement retention, the sharpening system may be used with a wide variety of implements and materials. For example, the sharpening of carbide components becomes possible with respect to a broad variety of tools.

Another feature of the invention provides apparatus for carrying out the sharpening of implements having a body portion and an edge for sharpening, employing a grinder positioned upon a work surface having a motor with a driven shaft carrying a circular grinding stone spaced a predetermined distance from the motor and having a grinding surface parallel with the shaft. A base member is provided which is supported by the work surface having a forward portion and being adjustably positionable along a path substantially transverse to said shaft to select positions adjacent the motor. A hinge is fixed to and movable with the base member forward portion and is pivotally movable about a hinge axis from a rearward mount position to forward grinding positions. A guide rod assembly is provided which is mounted upon and movable with the hinge and extends a predetermined operating distance from the hinge to an end location. A carriage having at least one linear bearing which is mountable upon the guide rod assembly for movement between the hinge and the end location and a gripping component is provided which is mounted upon the carriage and is hand actuable for receiving and securely retaining the implement body portion when the hinge is in the mount position and locates the edge in grinding association with the grinding surface when the guide rod assembly and the carriage are moved by the hinge pivotal movement to the forward grinding position.

Another feature of the invention provides apparatus for carrying out the sharpening of implements having a body portion and an edge for sharpening in conjunction with a bench grinder positioned upon a work surface, the grinder having a motor, a shaft axis, and an oppositely disposed circular grinding wheels rotatable about the shaft axis and spaced a predetermined distance from the motor and, additionally having grinding surfaces. A base member is supported by the work surface and being adjustably positionable along a path substantially transverse to the shaft axis to select positions adjacent the bench grinder intermediate the spaced grinding wheels. A hinge is fixed to the base member and has oppositely disposed sides and a hinge axis which is spaced upwardly from the base member. The hinge is pivotally movable about the hinge axis from a rearward mount position to forward grinding positions. A guide rod assembly is mounted upon and movable with the hinge about the hinge axis and extends to end locations from each of the hinge oppositely disposed sides a select distance greater than the predetermined distance between the grinding wheels. A carriage having at least one bearing is mountable upon the guide rod assembly, the carriage being is laterally movable upon the bearing across the guide rod assembly between a hinge side to a corresponding end location, the carriage having a bracket member selectively pivotal thereon about a bracket axis perpendicular to the hinge axis. A gripping component is provided which is mounted upon the carriage bracket member and hand actuable for receiving and removably retaining the implement body portion and is movable with the carriage and the guide rod assembly to locate the edge in grinding association with the grinding surface when the hinge is moved to a forward grinding position.

Another feature of the invention provides apparatus for carrying out the sharpening of implements having a body portion and an edge for sharpening in conjunction with a grinder assembly including a grinding wheel drivably rotatable about a shaft axis above a work surface. A base member is provided which is supported by a work surface and positionable along a path substantially transverse to the shaft axis to select positions adjacent the grinder assembly. A hinge assembly is provided including a hinge mount fixed to and movable with the base member and a hinge mounted upon that hinge mount at a location spaced from the base member and pivotally movable about a hinge axis from a rearward mount position to forward grinding positions. First and second mutually spaced and parallel guide rods are mounted upon the hinge and movable therewith, and have rod axes generally parallel with the hinge axis. The rods extend to end locations positioned outwardly of the grinding wheel when the base member is mounted upon the work surface. A carriage having bearings is provided which is mountable upon the first and second guide rods. The carriage is laterally movable upon the bearing across the guide rods between the hinge and the end locations. A gripping component is mounted upon the carriage for receiving and removably retaining the implement body portion and is hand actuable to pivotally move the carriage, the first and second guide rods with the hinge about the hinge axis to a forward grinding position to locate the edge in grinding association with the grinding wheel.

Other objects of the invention will, in part, be obvious and will, in part, appear hereinafter.

The invention, accordingly, comprises the apparatus and system possessing the construction, combination of elements, and arrangement of parts which are exemplified in the following description.

For a fuller understanding of the nature and objects of the invention, reference should be had to the following detailed description taken in connection with the accompanying drawings.

BRIEF DESCRIPTION OF THE DRAWINGS

FIG. 1 is a perspective view of the system of the invention showing a bench grinder and workpiece holding and maneuvering apparatus according to the invention, the apparatus being revealed in a grinding position;

FIG. 2 is a top view of the system of FIG. 1 showing alternate locations of the carriage assembly thereof in conjunction with a bench grinder which; in turn, is shown in phantom;

DETAILED DESCRIPTION OF THE INVENTION

Figure 3:
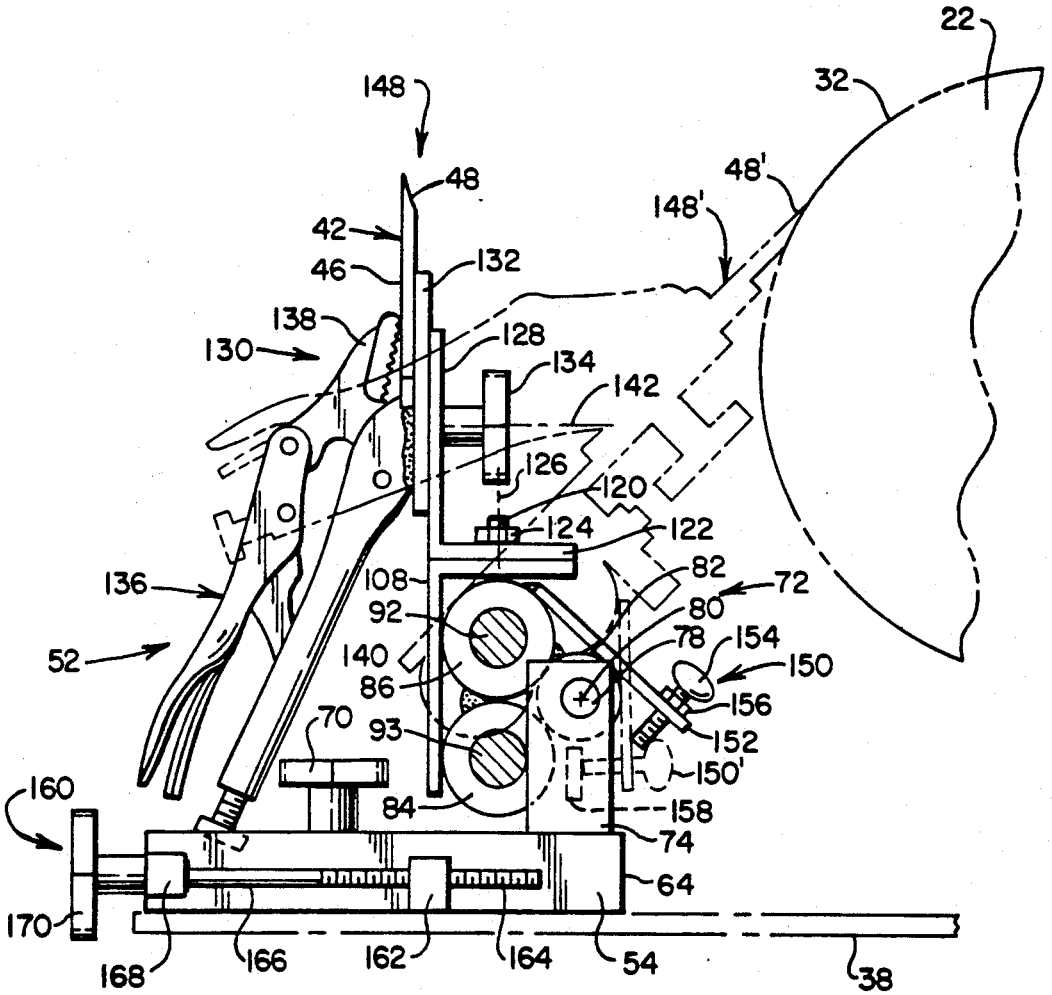
FIG. 3 is a partial sectional view taken through the plane 3—3 of FIG. 2 which additionally shows the workpiece retaining orientation in a mount position and, in phanton, in a grinding position.

Referring to FIG. 1, the association of the apparatus of the invention in combination with a conventional dual grinding wheel bench grinder is revealed generally at 10. The bench grinder of the assemblage 10 is represented at 12 and is seen to be structured in typical fashion having a shaft (not shown) with a shaft axis 14 and extending outwardly from a centrally disposed electric motor 16. Note, in this regard, that a grinding wheel or stone 18 extends axially outwardly from the body portion of motor 16 a predetermined distance as represented by the collar 20. The grinder 12 is symmetrically configured, having a second grinding wheel or stone 22 attached to its elongate shaft for rotation about axis 14. As before, stone or grinding wheel 22 is spaced from the body of the motor 16 a predetermined distance generally established by the collar and associated support mechanism as at 24. About each of the grinding wheels 18 and 22 there is positioned a guard shown, respectively, at 26 and 28 having an opening exposing a region of the grinding surfaces 30 and 32 of respective grinding wheels 18 and 22. Bench grinder 12 is positioned upon an upstanding pedestal support represented at 34 having an upwardly disposed platform 36. Intermediate the platform 36 and bench grinder 12 is a plate shaped work surface 38 through which bolts retaining the bench grinder 12 to platform 36 extend to secure it in position. One such retaining bolt is shown, for example, at 40. Positioned before the grinding wheel 22 of the system 10 is a workpiece 42 such as a mower blade. The workpiece is retained in a grinding position by the operator one of whose hands is revealed at 44. Workpiece 42 includes a body portion 46 and an edge to be sharpened 48. In general, movement for the sharpening or grinding action which occurs principally is one which is lateral or parallel with the axis A as represented by the arrow 50.

Mower blade 42 is maneuvered by the operator 44 in conjunction with a retaining apparatus represented generally at 52 which includes a base member 54 formed as a channel, the oppositely disposed edges 56 and 58 of which engage the upwardly disposed portion of the work surface 38. The base 54 is slideably movable upon the work surface 38 and a more precise sliding engagement is permitted because of the dual edge contact developed with a channel form of component. To guide the base member 54 inwardly and outwardly in a direction perpendicular to the bench grinder 12 shaft axis 14, two small rectangular guides 60 and 62 are attached to work surface 38. Once the forward portion 64 of base member 54 is properly located, the channel is retained in position by a clamping action achieved by an upstanding threaded stud 66 which is attached to work surface 38 and extends through a slot 68 in the upper surface of base member 54. A threaded tightening knob or "T-nut"70 is hand turned to clamp base member 54 to work surface 38.

Looking additionally to FIGS. 2 and 3, a hinge represented generally at 72 is attached, for example by welding to the forward portion 64 of base member 54. Hinge 72 includes two upstanding sides seen in FIG. 2 at 74 and 76. These upstanding sides 74 and 76 support a hinge shaft seen in FIG. 3 at 78 having a hinge axis represented by the dot 80 which is parallel to shaft axis 14 and above the upper surface of base member 54. The figure further reveals that the hinge shaft 80 extends through a cylindrical hinge bushing 82 which is positioned between the upstanding sides 74 and 76. Welded to hinge bushing 82 are two cylindrical guide rod retainers 84 and 86.

FIGS. 1 and 2 reveal that a guide rod assembly represented generally at 90 is supported by the cylindrical guide rod retainers 84 and 86. Assembly 90 is seen to be formed of parallel cylindrical guide rods 92–95 aligned along axes parallel to the hinge axis 80. Rods 92–95 are quite rigid to enhance the accuracy of the apparatus. Formed, for example, of bearing-quality high carbon alloy hardened to Rockwell 60 to 65C values, the shafts provide a guide rod assembly which is quite rigid to achieve accuracy for the grinding purpose at hand. The guide rods are available, for example, from Thomson Industries, Inc. of Manhasset, N.Y. Note that each of the guide rods 92–93 extend from one side of the hinge 72 to end positions which, in turn, are seen to extend at least coextensive and preferably beyond the outer location of the grinding wheels 18 and 22.

Figure 4:
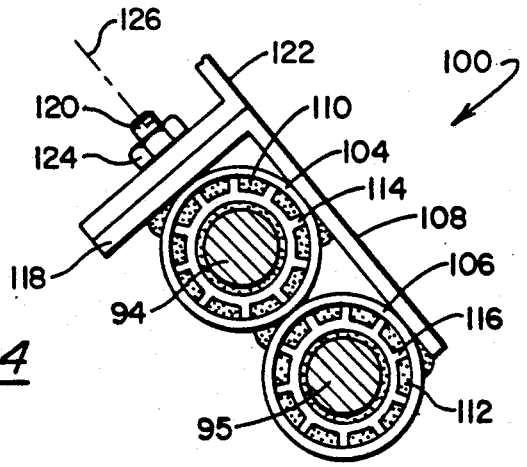
FIG. 4 is a partial sectional view taken through the plane 4—4 in FIG. 2.

Slideably mounted upon the guide rail assembly 90 is a carriage 100 which may be slideably mounted over either of the end locations of guide rods 94 and 95 as shown in FIG. 1 or may be slideably mounted over the end locations of guide rods 92 and 93 as shown in phantom at 100' in FIG. 2. Looking additionally to FIG. 4, carriage 100 is seen to be formed of two cylindrical, linear bearings 104 and 106 which are weldably secured to an angle shaped mount 108. Linear bearings 104 and 106 may, for example, be those provided by Thomson Industries, Inc., Manhasset, N.Y. and are seen to be slideably positioned upon guide rails as at 94, 95, or 92, 93. Thus, each of the rigid and hardened guide rods form an inner race for an associated lateral bearing. To assure the integrity of these accurate bearings, felt washer type dust covers may be positioned over each side thereof. FIG. 4 shows two of these dust covers as at 110 and 112 positioned over one side of respective linear bearings 104 and 106. The dust covers 110 and 112 are retained in position by spider-like retaining clips two of which seen respectively associated with covers 110 and 112 at 114 and 116. The upper surface or upper component 118 of L-shaped mount 108 is seen in FIG. 4 to support a threaded stud 120 over which an L-shaped bracket 122 is mounted for selective pivoting by tightening or untightening nut 124 secured to stud 120. This stud 120 defines a bracket axis 126 as seen in FIG. 4 which is perpendicular to the hinge axis 80. Accordingly, as assemblage is provided for selective orientation of the bracket 122 to permit a rotation of the workpiece 42 thereabout. This supports one degree of pivotal movement of the workpiece 42 to accommodate for blades, tools, and the like of varying or unusual shapes.

L-shaped bracket 122 is configured having an upstanding flange seen at 128 in FIG. 3. Pivotally mounted to the flange 128 is a gripping component represented generally at 130 which includes a grip plate 132 having a threaded stud (not shown) extending through an aperture (not shown) formed, in turn, within the middle of upstanding flange 128. This threaded stud is retained in position to secure the grip plate 132 in any desired orientation about a grip axis by a tightening knob or "T-nut"134. FIG. 3 shows that the body portion 46 of the workpiece 42 is retained against the outwardly disposed surface of grip plate 132 by one side of a pair of conventional over-center locking pliers represented generally at 136. Note that the upper grip portion of the pliers 136 as at 138 remain intact, while the corresponding lower component, otherwise affixed to plier grip component 140 has been removed and that component has been welded to gripping plate 132. Thus, a generally downwardly extending gripping portion of the locking pliers 136, which may be grasped by the user at a safe location is represented at 44 and 136 in FIG. 1. This approach to mounting workpiece 42 to the carriage 100 is quite simple and time saving. Only one grip device is necessitated and the gripping procedure is one of simply maneuvering the over-center handle component of pliers 136. The noted pivotal mounting of gripping component 130 utilizing the T nut 134 assemblage, provides for its pivoting about the earlier noted grip axis 142 as seen in FIG. 3. Looking additionally to FIG. 2, it may be observed that the workpiece 42 thus may be afforded another degree of pivotal freedom for mounting or setting up different shapes of implement. For example, the workpiece 42 readily is oriented as represented in FIG. 2 to achieve the phantom arrangement of workpiece and grip components shown at 42', 132', and 136'.

Returning to FIG. 3, the assemblage is seen having been pivoted rearwardly about hinge axis 80 to a mount position represented in general at 148. At this mount position 148, the workpiece 42 may be adjusted or mounted by the operator at a location remote from the grinding process involving grinding wheel 22. This vertical orientation not only facilitates the process of mounting itself, but its spacing from the bench grinder promotes safety of utilization of the apparatus. When the workpiece 42 is appropriately mounted, the assemblage may be rotated about hinge axis 80 to a working or grinding position represented in FIG. 3 at 148' and additionally seen in FIGS. 1 and 2. Note in FIG. 3 that the edge to be sharpened, now revealed at 48', is in the upper quadrant of the exposed surface 32 of grinding wheel 22. This also is a safer orientation for the workpiece 42. When in this orientation, the operator 44 moves the carriage 100 laterally in the directions of arrow 50 as seen in FIG. 1. Note that the inner hand of the operator at 44 is well displaced from the grinding activity between edge 48 and surface 32.

Returning to FIG. 3, an advantageous adaptation for the hinge 72 is shown. In the figure, a cutting depth control bracket is represented generally at 150. Bracket 150 includes a bracket plate 152 having a threaded bore therein (not shown) into which is threadably engaged a thumbscrew 154 and locking nut 156. The thumbscrew 154 is arranged such that it will abuttably engage a cross bar 158 extending between hinge sides 74 and 76 (FIG. 2) when the assembly is moved to the grinding position 148'. Thus, by appropriately manipulating the position of thumb screw 154, depth of cut of the edge of workpiece 52 as shown at 148' may be adjusted.

Another adjustment feature which may be incorporated with the apparatus also is shown in FIG. 3. In the figure, a base adjustment assembly is shown at 160. Assembly 160 facilitates a very fine adjustment of the position of base 54 with respect to the surface, for example 32, of grinding wheel 22. To provide this form of "vernier" adjustment, an anchor block 162 is fixed to work surface 38 which contains a threaded bore (not shown) into which the threaded end 164 of an adjustment rod 166 is located. The outwardly disposed end of rod 166 is connected with base 54 through a thrust bushing block 168 to provide for lateral inward or outward drive of the base 54 upon appropriate rotation of rod 166. This rotation is carried out by the hand manipulation of an adjustment knob 170 which is fixed to rod 166.

Looking again to FIG. 2, shown in phantom therein is the positioning of carriage 100 upon the guide rods 92 and 93 of guide rod assembly 90. This positioning is easily carried out, the assemblage being pulled off of guide rods 94 and 95 and inserted over corresponding rods 92 and 93. With this arrangement, a mower blade workpiece as at 42" which, for example, performs with mowers having "left hand" rotational blade drives can be sharpened using grinding wheel 18.

Since certain changes may be made to the above-described system and apparatus without departing from the scope of the invention herein involved, it is intended that all matter contained in the description thereof or shown in the accompanying drawings shall be interpreted as illustrative and not in a limiting sense.

I claim:

1. Apparatus for carrying out the sharpening of implements having a body portion and an edge for sharpening, employing a grinder positioned upon a work surface, having a motor with a driven shaft carrying a circular grinding stone spaced a predetermined distance from said motor and having a grinding surface parallel with said shaft, comprising:

a base member supportable by said work surface having a forward portion and being adjustably positionable along a path substantially transverse to said shaft to select positions adjacent said motor;

a hinge fixed to and movable with said base member forward portion and pivotally movable about a hinge axis from a rearward mount position to forward grinding positions;

a guide rod assembly mounted upon, movable with said hinge, and extending a predetermined operating distance from said hinge to an end location;

a carriage having at least one linear bearing, said bearing being mountable upon said guide rod assembly for freely slidable movement between said hinge and said end location and said carriage being movable with said guide rod assembly about said hinge axis; and a gripping component mounted upon said carriage and hand actuable for receiving and securely retaining said implement body portion when said hinge is in said mount position and for locating said edge in grinding association with said grinding surface when said hinge, said guide rod assembly and said carriage are moved by said pivotal movement to a said forward grinding position.

2. The apparatus of claim 1 in which said gripping component is pivotally mounted upon said carriage for select movement about a grip axis perpendicular to said hinge axis.

3. The apparatus of claim 1 including a bracket member pivotally mounted upon said carriage for select movement about a bracket axis perpendicular to said hinge axis and configured for supporting said gripping component.

4. The apparatus of claim 3 in which said gripping component is pivotally mounted upon said bracket member for select movement about a grip axis perpendicular to both said hinge axis and said bracket axis.

5. The apparatus of claim 1 in which said guide rod assembly comprises first and second mutually spaced and parallel guide rods.

6. The apparatus of claim 5 in which said gripping component comprises over-center clamping pliers having a generally downwardly extending gripping portion hand graspable and manipulable to cause said guide rod assembly and said carriage to pivotally move with said hinge pivotal movement, and further, to effect movement of said carriage along said first and second guide rods.

7. The apparatus of claim 1 including a cutting depth assembly having a stationary abutting component fixed to said hinge adjacent said base, an adjustment mount fixed to and pivotal with said hinge and an adjustment member threadably engaged with said adjustment mount and having an end abuttably engageable with said abutting component.

8. The apparatus of claim 1 including a base adjustment assembly having an anchor block fixed to said work surface and an adjustment rod threadably engaged with said anchor block, fixed to and rotatable within said base for effecting select movement of said base into and away from said grinder.

9. Apparatus for carrying out the sharpening of implements having a body portion and an edge for sharpening in conjunction with a bench grinder positioned upon a work surface having a motor, a shaft axis and oppositely disposed circular grinding wheels, rotatable about said shaft axis, spaced a predetermined distance from said motor and having a grinding surface, comprising:

a base member supportable by said work surface and being adjustably positionable along a path substantially transverse to said shaft axis to select positions adjacent said bench grinder intermediate said spaced grinding wheels;

a hinge fixed to and movable with said base member and having oppositely disposed sides, a hinge axis spaced upwardly from said base member, said hinge being pivotally movable about said hinge axis from a rearward mount position to forward grinding positions;

a guide rod assembly mounted upon and movable with said hinge about said hinge axis and extending to end locations from each said hinge oppositely disposed sides a select distance greater than said predetermined distance;

a carriage having at least one bearing mountable upon said guide rod assembly, said carriage being laterally movable upon said bearing across said guide rod assembly between a said hinge side to a corresponding said end location, said carriage having a bracket member selectively pivotal thereon about a bracket axis perpendicular to said hinge axis; and a gripping component mounted upon said carriage bracket member and hand actuable for receiving and removably retaining said implement body portion and pivotally movable with said carriage and said guide rod assembly to locate said edge in grinding association with said grinding surface when said hinge is moved to a said forward grinding position.

10. The apparatus of claim 9 in which said hinge and carriage are dimensioned to effect a positioning of said implement edge at a said grinding wheel cutting surface location substantially above said shaft axis.

11. The apparatus of claim 9 in which said hinge is positioned forwardly upon said base member for providing an adjacency thereof with said motor.

12. The apparatus of claim 9 in which said gripping component is pivotally mounted upon said carriage bracket member for select movement about a grip axis perpendicular to said bracket axis and said hinge axis.

13. The apparatus of claim 9 in which:

said guide rod assembly comprises first and second mutually spaced, cylindrical and parallel guide rods formed of steel to derive an inner race surface; and said carriage bearings include first and second linear bearings removably engageable with respective said first and second guide rods.

14. The apparatus of claim 9 in which said base member is formed having a channel cross section for providing an edge contact association with said work surface.

15. The apparatus of claim 9 including a downwardly extending gripping lever fixed to said carriage and hand graspable and manipulable to cause said guide rod assembly and said carriage to pivotally move with said hinge pivotal movement and, further, to effect movement of said carriage along said guide rod assembly.

16. The apparatus of claim 9 in which said gripping component comprises overcenter clamping pliers having a generally downwardly extending gripping portion hand graspable to cause said hinge pivotal movement and to effect movement of said carriage along said first and second guide rods.

17. Apparatus for carrying out the sharpening of implements having a body portion and an edge for sharpening in conjunction with a grinder assembly including a grinding wheel drivably rotatable about a shaft axis above a work surface, comprising:

a base member supportable by said work surface and being adjustably positionable along a path substantially transverse to said shaft axis to select positions adjacent said grinder assembly;

a hinge assembly including a hinge mount fixed to and movable with said base member and a hinge mounted upon said hinge mount at a location spaced from said base member and pivotally movable about a hinge axis from a rearward mount position to forward grinding positions;

first and second mutually spaced and parallel guide rods mounted upon said hinge, movable therewith and having rod axes generally parallel with said hinge axis and extending to end locations positioned outwardly of said grinding wheel when said base member is mounted upon said work surface;

a carriage having bearings mountable upon said first and second guide rods, said carriage being laterally movable upon said bearings across said guide rods between said hinge and said end locations; and a gripping component mounted upon said carriage for receiving and removably retaining said implement body portion and hand actuable to pivotally move said carriage, said first and second guide rods with said hinge about said hinge axis to a said forward grinding position to locate said edge in grinding association with said grinding wheel.

18. The apparatus of claim 17 in which:

said first and second guide rods are cylindrical and formed of a rigid material selected to provide an inner race surface; and said carriage bearings include first and second linear bearings removably engageable with respective said first and second guide rods.

19. The apparatus of claim 17 including a downwardly extending gripping lever fixed to said carriage and hand graspable and manipulable to cause said hinge pivotal movement and to effect movement of said carriage along said guide rod assembly.

20. The apparatus of claim 17 including a bracket member pivotally mounted upon said carriage for select movement about a bracket axis perpendicular to said hinge axis and configured for supporting said gripping component.

21. The apparatus of claim 17 in which said gripping component comprises over-center clamping pliers having a generally downwardly extending gripping potion hand graspable and manipulable to cause said first and second parallel guide rods and said carriage to pivotally move with said hinge pivotal movement and to, further, effect movement of said carriage along said first and second guide rods.

* * * * *